US005758765A

United States Patent [19]

Ovadia

[11] Patent Number: 5,758,765

[45] Date of Patent: Jun. 2, 1998

[54] JEWELRY PAD WITH HINGED BOTTOM COVER

[76] Inventor: Joseph Ovadia, 106 Long Hill Rd., Little Falls, N.J. 07424

[21] Appl. No.: 780,162

[22] Filed: Dec. 26, 1996

[51] Int. Cl.[6] ..... B65D 5/50

[52] U.S. Cl. ..... 206/6.1; 206/566

[58] Field of Search ..... 206/6.1, 565–566, 206/495, 775; 220/339, 660, 625, 638

[56] References Cited

U.S. PATENT DOCUMENTS

| | | | |
|---|---|---|---|
| 3,899,072 | 8/1975 | Reinhart | 206/564 |
| 4,043,450 | 8/1977 | Rielly | 206/6.1 |
| 4,120,394 | 10/1978 | Soltes | 206/6.1 |
| 4,432,456 | 2/1984 | Ovadia et al. . | |
| 4,552,264 | 11/1985 | Quarrell et al. | 206/6.1 |
| 4,732,269 | 3/1988 | Roy | 206/6.1 |
| 4,848,585 | 7/1989 | Snyder | 206/566 |
| 5,127,537 | 7/1992 | Graham | 220/339 |
| 5,511,653 | 4/1996 | Ovadia | 206/6.1 |
| 5,547,072 | 8/1996 | Kaiser | 206/6.1 |

*Primary Examiner*—B. Dayoan
*Assistant Examiner*—Luan K. Bui
*Attorney, Agent, or Firm*—Richard M. Goldberg

[57] ABSTRACT

A jewelry pad for holding jewelry items, includes an upper wall having an upper exposed surface; substantially parallel side walls connected to side edges of the upper wall and a rear wall connected to a rear edge of the upper wall and to side edges of the side walls for supporting the upper wall on a surface; two L-shaped projections on the upper wall for holding a jewelry item on the upper exposed surface; a hollow area at an underside of the upper wall and between the side walls and rear wall, the hollow area having an open portion at a lower side of the side walls and rear wall; a bottom cover hingedly secured to the rear wall and hingedly movable between a first position in closing relation to the open portion and the hollow area and a second position permitting access to the hollow area through the open portion; two hinges connected between the bottom cover and the rear wall to hingedly secure the bottom cover to the rear wall for movement between the first and second positions; a substantially vertical slit between each side wall and the rear wall for receiving a necklace chain therethrough; and a reinforcing wall connected between each side wall and the rear wall to reinforce a connection between the side walls and the rear wall.

16 Claims, 4 Drawing Sheets

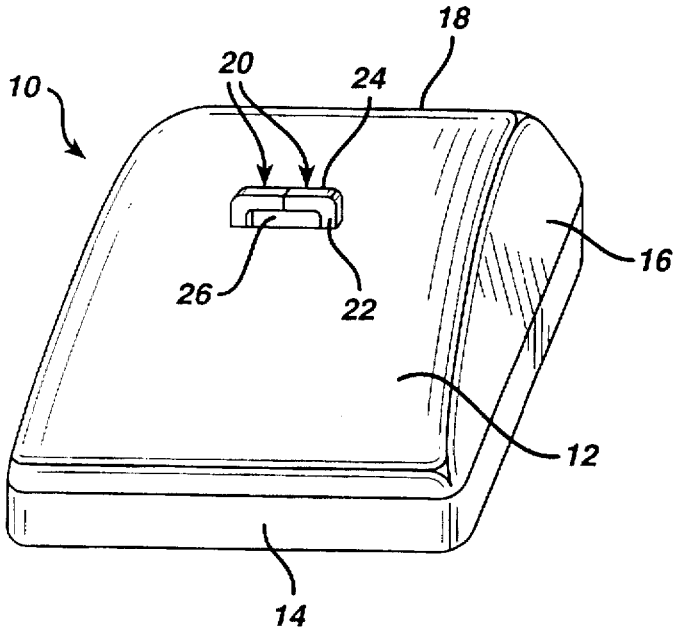
FIG. 1
FIG. 2
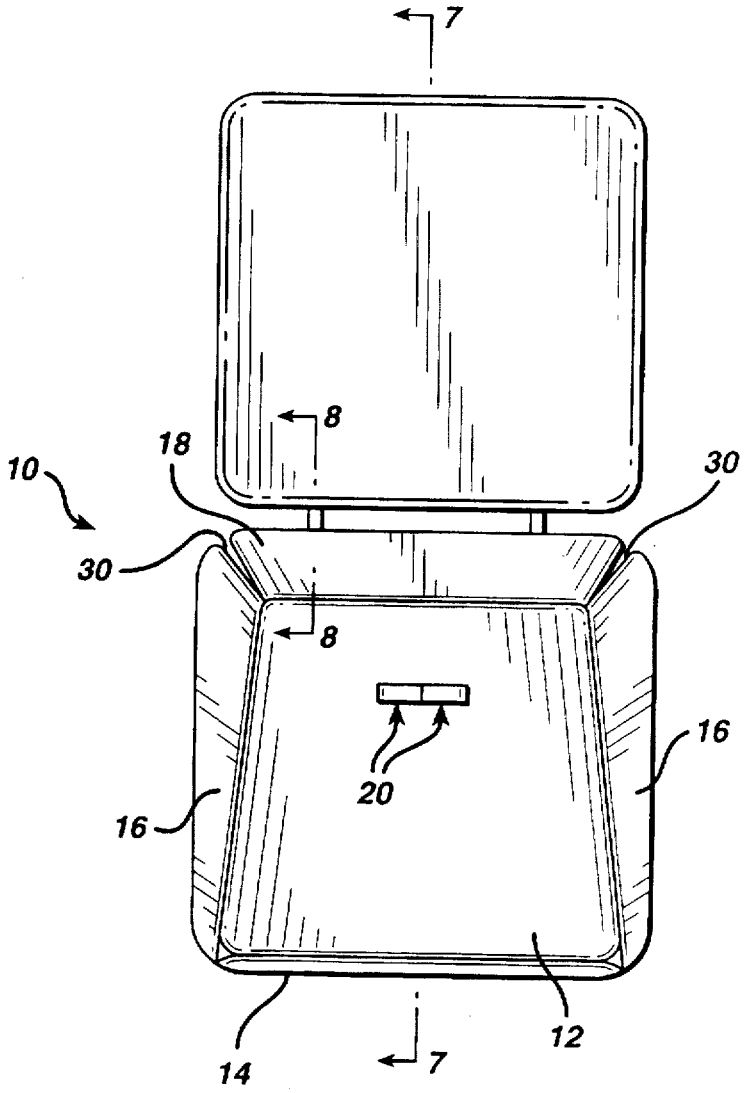

JEWELRY PAD WITH HINGED BOTTOM COVER

BACKGROUND OF THE INVENTION

The present invention relates generally to jewelry pads, and more particularly, is directed to a jewelry pad with a hinged bottom cover.

Jewelry pads which are adapted to fit within recesses of a jewelry tray and held therein, are well known.

Conventionally, jewelry pads of this type for displaying jewelry items such as pendants, earrings and the like include a substantially rectangular upper inclined wall that extends upwardly and rearwardly from the upper edge of a short front wall at an inclination to the ground surface. Side walls of a substantially triangular configuration have their upper inclined edges connected with respective side edges of the upper inclined wall. A substantially rectangular rear wall has its upper edge connected with the rear edge of the upper inclined wall and its opposite side edges connected to the rear edges of the triangular side walls. The rear wall may be inclined rearwardly and downwardly. With this arrangement, the lower edges of the front wall, side walls and rear wall lie in the same horizontal plane and support the pad on a flat surface.

In accordance with prior inventions of the same applicant herein, each pad is preferably made from a flexible and resilient plastic material that can be deformed but which retains its shape when the deformation force is removed. Thus, the pad is preferably made of a high memory material with a substantially thin, constant thickness throughout. As a result, the pad has a hollow area defined between the underside of the inclined upper wall and the front wall, side walls and rear wall.

According to a prior invention by the same applicant herein, as described in copending U.S. patent application Ser. No. 08/465,142, filed Jun. 5, 1995, and the entire disclosure of which is incorporated herein by reference, different projections are formed on the upper exposed surface of the inclined upper wall for holding jewelry items such as the bails of pendants thereon. In such case, a necklace chain is often displayed with the pendant, that is, extending through the bail thereof. However, the major portion of the necklace chain is positioned to the rear of the jewelry pad and within the hollow area. In some cases, as in U.S. Pat. No. 4,432,456, the entire disclosure of which is incorporated herein by reference, and in which the inventor herein is one of the named inventors thereof, slots are provided in the pad for receiving the necklace chain in order to grip the same without damaging the chain.

However, a problem with such arrangement is that when the jewelry pad is removed from the tray to show a customer, the chain falls out of the hollow area and detracts from the display. When it is necessary to reinsert the jewelry pad back into the jewelry tray, the chain must be stuffed back into the hollow area and carefully placed within the jewelry tray, which becomes cumbersome over repeated times.

In some cases, the chain is taped within the hollow area. However, this becomes burdensome to use, and must be reapplied each time the jewelry item is removed from the pad. In other cases, an envelope is glued in the hollow area for receiving the chain. Again, this becomes cumbersome in practice.

Further, the inclusion of slots in the jewelry tray wall reduces the structural integrity of the jewelry pad, particularly when the slots are placed at the rear corners of the jewelry pad, thereby separating the side walls and the rear wall. In such case, when the jewelry pad stands alone so that it is not held by a jewelry tray or box, the rear wall tends to diverge or move away from the side walls over time, and repeated removal and reapplication of the necklace chain within the slots tends to provide a somewhat permanent deformation which increases the size of the slots and makes holding of the necklace chains more difficult over time.

OBJECTS AND SUMMARY OF THE INVENTION

Accordingly, it is an object of the present invention to provide a jewelry pad that overcomes the problems with the aforementioned prior art.

It is another object of the present invention to provide a jewelry pad having a hinged cover that can be moved between a first position in closing relation to the hollow area at the underside thereof, and a second position permitting access to the hollow area.

It is still another object of the present invention to provide a jewelry pad in which the hinges are living hinges.

It is yet another object of the present invention to provide a jewelry pad in which the jewelry pad, hinges and cover can be molded as an integral, one-piece construction.

It is a further object of the present invention to provide a jewelry pad having slits at the rear corners thereof for receiving the necklace chain.

It is a still further object of the present invention to provide a jewelry pad in which structural reinforcing walls extend between the side walls and the rear wall in order to provide additional structural integrity at the slitted area.

It is a yet further object of the present invention to provide a jewelry pad in which the reinforcing walls are U-shaped walls connected between each side wall and the rear wall, with the respective slit bisecting the same.

In accordance with an aspect of the present invention, a jewelry pad for holding jewelry items, includes an upper wall having an underside and an upper exposed surface; a bottom cover hingedly secured with respect to the upper wall and movable between a first position in superposition to the underside of the upper wall such that a hollow area is defined between the upper wall and the cover, and a second position moved away from the upper wall; and two slits in the upper wall at opposite sides thereof for receiving and holding a chain of a jewelry item, the upper wall being made of a resilient, flexible material.

The cover includes a lower wall and a peripheral ledge, and the hollow area is defined between the underside of the upper wall, the lower wall of the cover and the peripheral ledge.

A living hinge hingedly connects the cover to the upper wall.

Further, means are provided on the upper exposed surface of the upper wall for holding a jewelry item thereon.

In accordance with another aspect of the present invention, a jewelry pad for holding jewelry pad, includes an upper wall having an upper exposed surface; at least one supporting wall connected to the upper wall for supporting the upper wall on a surface; a hollow area at an underside of the upper wall and between the at least one supporting wall, the hollow area having an open portion at a lower side of the at least one supporting wall; and a bottom cover hingedly secured to the at least one supporting wall and hingedly movable between a first position in closing relation to the open portion and the hollow area and a second position permitting access to the hollow area through the open portion.

Further, means are provided on the upper wall for holding a jewelry item on the upper exposed surface. The means includes at least one projection on an upper surface of the upper wall. At least one projection includes two L-shaped projections which face each other.

Further, at least one hinge is connected between the bottom cover and the at least one supporting wall and hingedly secures the bottom cover to the at least one supporting wall for movement between the first and second positions. Each hinge is a living hinge.

Also, at least one cut-out area is provided in the at least one supporting wall for receiving the hinge when the bottom cover is moved to the first position.

The at least one supporting wall includes substantially parallel side walls connected to side edges of the upper wall, and a rear wall connected to a rear edge of the upper wall, and each hinge is connected between the rear wall and the bottom cover.

The at least one supporting wall further includes a front wall having a detent threat for engaging with the bottom cover in the first position to releasably hold the bottom cover in the first position.

In addition, the at least one supporting wall includes substantially parallel side walls connected to side edges of the upper wall, and a rear wall connected to a rear edge of the upper wall, and a substantially vertical slit is provided between each side wall and the rear wall for receiving a necklace chain therethrough. A reinforcing wall is connected between each side wall and the rear wall to reinforce a connection between the side walls and the rear wall.

In accordance with still another aspect of the present invention, a jewelry pad for holding jewelry items, includes an upper wall having an upper exposed surface; at least one supporting wall connected to the upper wall for supporting the upper wall on a surface, the at least one supporting wall including substantially parallel side walls connected to side edges of the upper wall, and a rear wall connected to a rear edge of the upper wall; a hollow area at an underside of the upper wall and between the at least one supporting wall, the hollow area having an open portion at a lower side of the at least one supporting wall; a substantially vertical slit provided between each side wall and the rear wall for receiving a necklace chain therethrough; and a reinforcing wall connected between each the side wall and the rear wall to reinforce a connection between the side walls and the rear wall.

The slit substantially bisects a corresponding the reinforcing wall. Each reinforcing wall has a substantially inverted U-shape.

The above and other objects, features and advantages of the present invention will become readily apparent from the following detailed description thereof which is to be read in connection with the accompanying drawings.

DESCRIPTION OF THE DRAWINGS

Fig. 1 is a perspective view of a jewelry pad according to the preset invention, with the cover closed;

FIG. 2 is a top plan view of the jewelry pad of FIG. 1, with the cover open;

DETAILED DESCRIPTION OF THE PREFERRED EMBODIMENTS

Figure 3:
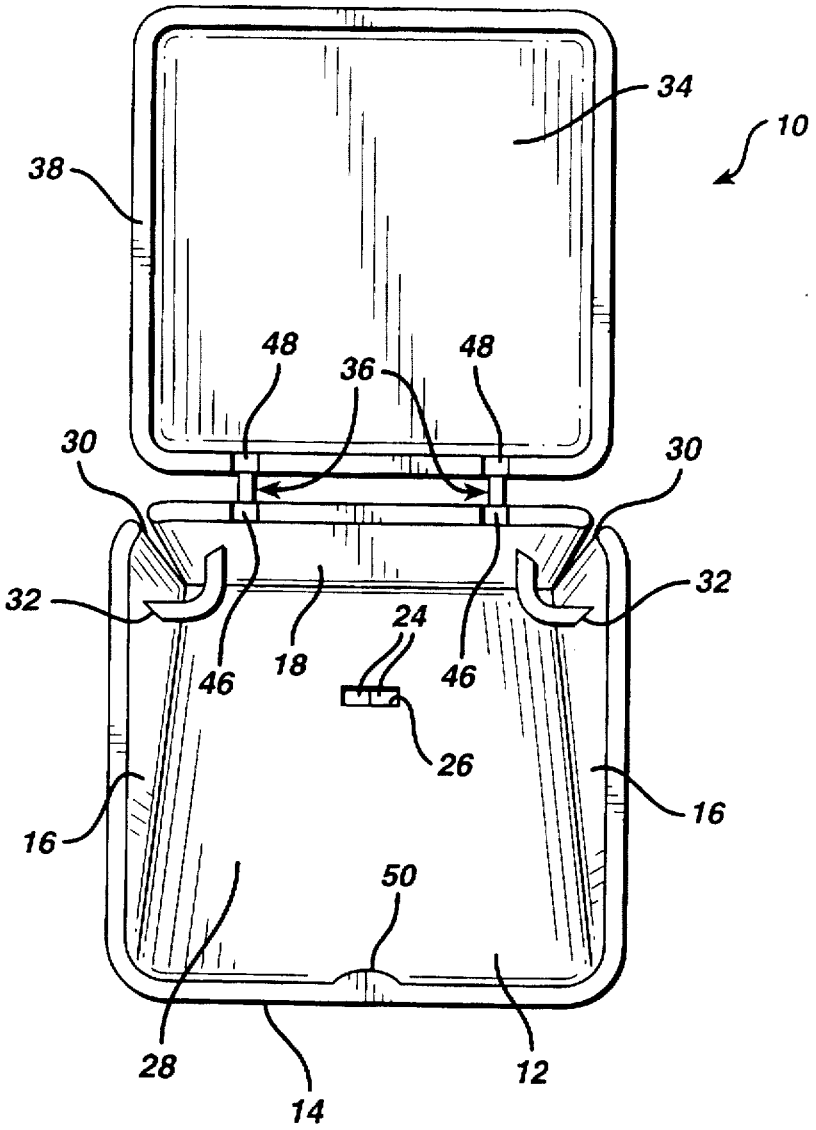
FIG. 3 is a bottom plan view of the jewelry pad of FIG. 1, with the cover open.
Figure 4:
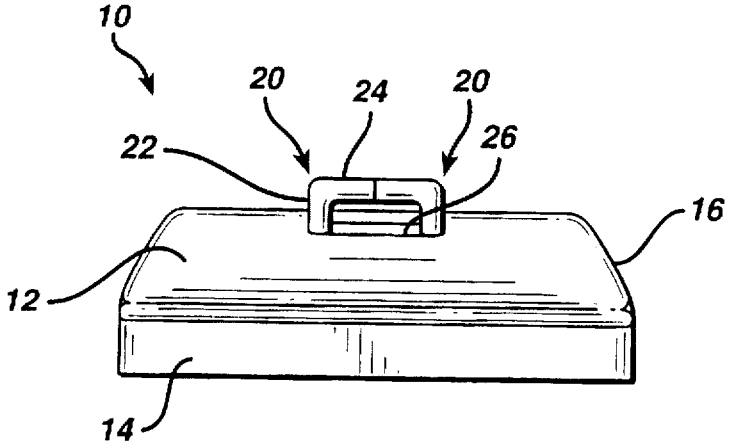
FIG. 4 is a front elevational view of the jewelry pad of FIG. 1.

Referring to the drawings in detail, a deformable and resilient jewelry pad 10 according to one embodiment of the present invention includes a substantially rectangular upper inclined wall 12 that extends upwardly and rearwardly from the upper edge of a short front wall 14 at an inclination of about 20° to the ground surface. Inclined wall 12 can have a slightly convex bowed configuration from its front edge to its rear edge. Side walls 16 of a substantially triangular configuration have their upper inclined edges connected with respective side edges of upper inclined wall 12. A substantially rectangular rear wall 18 has its upper edge connected with the rear edge of upper inclined wall 12 and its opposite side edges connected to the rear edges of triangular side walls 16. Rear wall 18 may be inclined rearwardly and downwardly at an inclination of, for example, about 15°. With this arrangement, the lower edges of front wall 14, side walls 16 and rear wall 18 lie in the same horizontal plane and support pad 10 on a flat surface.

Pad 10 is adapted to fit within one of many recesses of a jewelry tray (not shown), as is well-known, for example, as shown in U.S. Pat. No. 4,432,456.

Preferably, each pad 10 is made from a flexible and resilient plastic material that can be deformed but which retains its shape when the deformation force is removed. Alternatively, pad 10 can be made of a rubber or any other suitable material. In any event, pad 10 is made of a high memory material with a substantially thin, constant thickness throughout. Because pad 10 has a substantially constant thickness throughout, it is thin and therefore easily deformable, while reducing the amount of material that is used.

Thus, each pad 10 is formed as a single, unitary plastic molded part, although it is also possible to provide a fabric material or flocked layer thereon.

Specifically, unlike conventional jewelry pads, each pad 10 is formed in an injection molding operation, using pellets of an injection molding material, such as polypropylene, olefinic materials, polyurethane and other synthetic rubber, plastic rubber or flexible materials. An example of such a material is one sold under the trademark "KRATON". Thus, the pellets are placed in a conduit leading to a space between two molded halves. The pellets are heated to liquefy the same, and the liquid is forced under pressure to a space between the two closed mold halves to form the jewelry pad. Then, the mold is cooled, and the mold halves are separated, in order to remove the formed jewelry pad therefrom. Injection molded rubbery pads 10 are flexible and do not lose memory.

Figure 7:
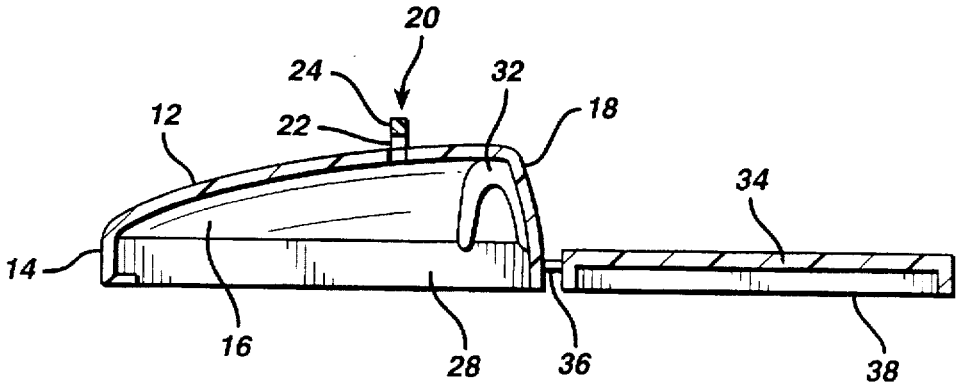
FIG. 7 is a cross-sectional view of the jewelry pad of FIG. 2, along taken along line 7—7 thereof.

In addition, two L-shaped projections 20 extend from the upper surface of upper wall 12 in facing and touching relation to each other. Specifically, each L-shaped projection 20 includes a vertically extending leg 22 and a horizontally extending leg 24 extending from the upper end of vertically extending leg 22, with the free ends of horizontally extending legs 24 being in contact with each other. Projections 20 are made of the same material as jewelry pad 10 and are formed in the same molding operation so as to be integral therewith. Thus, projections 20 are entirely flexible so that they can be bent in order to receive a bail of a jewelry pendant or other jewelry item therein. When released, projections 20 return to their initial positions in order to releasably secure the jewelry item thereto so that the jewelry item rests on the upper exposed surface of upper wall 12. This aspect of the jewelry pad 10 of the present invention is described and claimed in my earlier co-pending U.S. patent application Ser. No. 08/465,142, filed Jun. 5, 1995, the entire disclosure of which is incorporated herein by reference. In such case, it will be appreciated that any of the variations in said aforementioned U.S. patent application Ser. No. 08/465,142, are also incorporated herein by reference and can likewise be used with jewelry pad 10 according to the present invention. As a result of the formation of projections 20, an elongated through opening 26 is provided through upper wall 12, as shown best in FIGS. 1, 3 and 7.

With the above arrangement, the bail of a pendant can readily be held by projections 20 such that the pendant rests on the upper exposed surface of upper wall 12. As previously discussed, a necklace chain is often displayed with the pendant and wrapped about the rear of the jewelry pad and positioned within the hollow open area 28 defined between the underside of upper wall 12 and front wall 14, side wall 16 and rear wall 18. In order to provide for accurate positioning and good display of the necklace chain, corner slits 30 are provided between side walls 16 and rear wall 18. Thus, the necklace chain which extends through the bail of the pendant is positioned through slits 30, and then positioned within hollow open area 28. In order to avoid the problems of the prior art of U.S. Pat. No. 4,432,456, inverted U-shaped reinforcing walls 32 are provided so as to connect each side wall 16 with rear wall 18 at the inner surfaces thereof. Preferably, as shown in FIG. 3, slits 30 bisect reinforcing walls 32. Thus, with this arrangement, even when slits 30 are expanded many times to an open position to receive the necklace chains, reinforcing walls 32 function to limit the extent of opening of such slits 30 and therefore retain the structural integrity of pad 10.

Further, the portions of side walls 16 and rear wall 18 at slits 30 are thinned out so as to be more flexible and thereby better hold the chain.

In accordance with an important aspect of the present invention, a cover 34 is hingedly secured to rear wall 18 by living hinges 36. Cover 34 is made from the same material as jewelry pad 10 and is formed as a substantially square configuration with a peripheral ledge 38. The outer dimensions of bottom cover 34 are similar to the inner dimensions of pad 10 at the lower edge thereof defined by front wall 14, side wall 16 and rear wall 18 such that bottom cover 34, including peripheral ledge 38 thereof, fit within front wall 14, side walls 16 and rear wall 18 and the lower surface thereof is coplanar with lower edges of these walls. It will be appreciated that reinforcing walls 32 do not extend to the lower edges of side wall 16 and rear wall 18 in order not to interfere or contact the exposed free surface of peripheral ledge 38.

Figure 5:
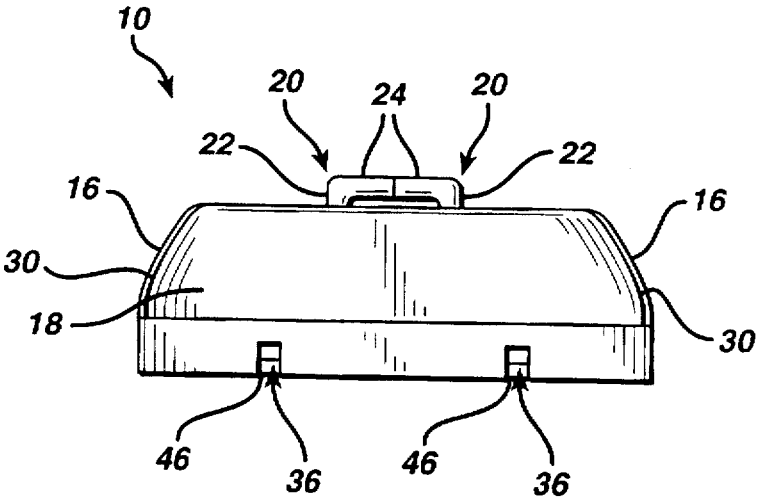
FIG. 5 is a rear elevational view of the jewelry pad of FIG. 1.
Figure 6:
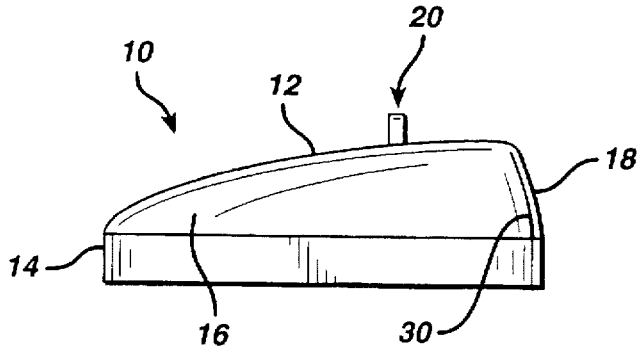
FIG. 6 is a right side elevational view of the jewelry pad of FIG. 1.
Figure 8:
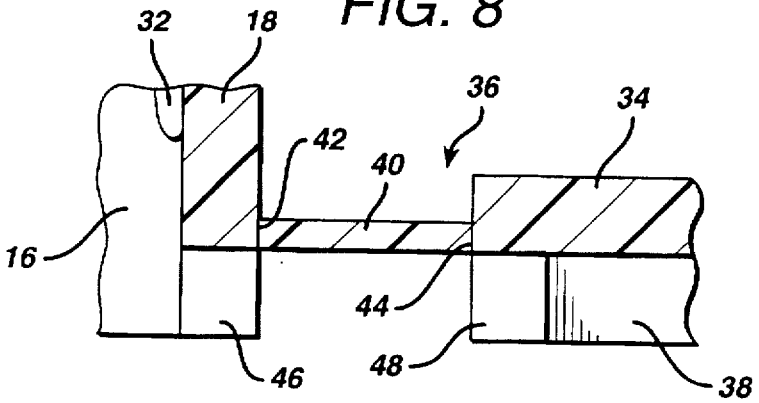
FIG. 8 is an enlarged, cross-sectional view of one living hinge, taken along line 8—8 of FIG. 2.

Referring to FIGS. 3, 5 and 8, each living hinge 36 is formed by a thin and narrow, elongated rectangular strip 40 having one end connected to rear wall 18 at hinge line 42 and the opposite end connected to cover 34 at hinge line 44. The lower edge of rear wall 18 is provided with two cut-out areas 46 immediately below and in alignment with strips 40 in order to receive the same therein when cover 34 is closed. In like manner, peripheral ledge 38 of cover 34 includes two cut-out areas 48 that receive strips 40 when cover 34 is in the closed position.

With this arrangement, when necklace chain is inserted through slits 30 into hollow area 28, cover 34 can be closed so as to retain the necklace chain therein. Accordingly, when jewelry pad 10 is removed from a jewelry tray to show the pendant or other jewelry item to a customer, the chain does not fall out and is retained within hollow area 28.

In order to releasably latch cover 34 in the closed position, a small, arcuate detent 50 is provided at the center of the inner surface of front wall 14 adjacent the lower edge thereof. Accordingly, detent 50 functions to provide a catch to retain cover 34 in the closed position. In order to open cover 34, a finger can be used to deform front wall forwardly and rear wall 18 and cover 34 rearwardly in view of the deformable and resilient nature of the jewelry pad.

It will therefore be appreciated that, with the present invention, a necklace chain can be inserted within hollow area 28 and will not fall out therefrom when the jewelry pad is removed from a jewelry tray to show the jewelry item to a customer. As a result, the cumbersome process of reinserting the necklace chain back into hollow area 28 is eliminated. At the same time, the necklace chain is held within slits 30, with the connection between side wall 16 and rear wall 18 being reinforced by reinforcing walls 32.

It will further be appreciated that the entire assembly of jewelry pad 10, cover 34 and living hinges 36 are made of the same resilient and deformable plastic material and are integrally molded together as one piece in a molding operation, as aforesaid.

As a first alternative embodiment, it will be appreciated that projections 20 can be eliminated, so that the pendant is supported solely by the chain on upper wall 12.

As a second alternative embodiment, front wall 14, side walls 16 and rear wall 18 can be eliminated so that the hollow area is defined by the underside of wall 12, the inner surface of cover 34 and peripheral ledge 38.

As a further alternative, cover 34 can be made of a separate piece, not attached to jewelry pad 10. In such case, another detent 50 can be provided at the center of the inner surface of rear wall 18 adjacent the lower edge thereof, with both detents 50 functioning to hold cover 34 in place.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

What is claimed is:

1. A jewelry pad for holding jewelry items, comprising:

an upper wall having an underside and an upper exposed surface for holding a jewelry item thereon;

a peripheral wall secured to the upper wall around a periphery of the upper wall, with lower edges of the peripheral wall being supportable on a surface so that the upper wall is spaced above the surface;

means on at least one of said upper wall and said peripheral wall for holding a jewelry item on said upper exposed surface;

a hollow area at the underside of said upper wall and between said peripheral wall, said hollow area having an open portion at a lower side of said peripheral wall for containing a necklace connected with the jewelry item when the jewelry item is held on the upper exposed surface; and a bottom cover hingedly secured to the peripheral wall and movable between a first closed position substantially coplanar with the lower edge of the peripheral wall and in closing relation to said open portion to prevent access to said hollow area, and a second opened position moved away from the upper wall and the lower edge of the peripheral wall to permit access to the hollow area through said open portion, with the jewelry item being viewable regardless of whether the bottom cover is in the closed or opened position.

2. A jewelry pad according to claim 1, wherein the jewelry pad is made of a resilient, flexible material.

3. A jewelry pad according to claim 1, wherein said cover includes a lower wall and a peripheral ledge.

4. A jewelry pad according to claim 1, further comprising a living hinge which hingedly connects the cover to the upper wall.

5. A jewelry pad according to claim 1, wherein said means includes at least one projection on an upper surface of said upper wall.

6. A jewelry pad according to claim 1, further comprising at least one hinge connected between said bottom cover and said peripheral wall and which hingedly secures said bottom cover to said peripheral wall for movement between said first and second positions.

7. A jewelry pad according to claim 6, wherein each said hinge is a living hinge.

8. A jewelry pad according to claim 6, further comprising at least one cut-out area in said peripheral wall for receiving said hinge when said bottom cover is moved to said first position.

9. A jewelry pad according to claim 6, wherein said peripheral wall includes substantially parallel side walls connected to side edges of said upper wall, and a rear wall connected to a rear edge of said upper wall, and each said hinge is connected between said rear wall and said bottom cover.

10. A jewelry pad according to claim 9, wherein said peripheral wall further includes a front wall having a detent threat for engaging with said bottom cover in said first position to releasably hold said bottom cover in said first position.

11. A jewelry pad according to claim 1, wherein said peripheral wall includes substantially parallel side walls connected to side edges of said upper wall, and a rear wall connected to a rear edge of said upper wall, and said means includes a substantially vertical slit provided between each side wall and said rear wall for receiving a necklace chain therethrough.

12. A jewelry pad according to claim 11, further comprising a reinforcing wall connected between each said side wall and said rear wall to reinforce a connection between said side walls and said rear wall.

13. A jewelry pad for holding jewelry items, comprising:

an upper wall having an upper exposed surface;

at least one supporting wall connected to the upper wall for supporting the upper wall on a surface;

a hollow area at an underside of said upper wall and between said at least one supporting wall, said hollow area having an open portion at a lower side of said at least one supporting wall;

a bottom cover hingedly secured to said at least one supporting wall and hingedly movable between a first position in closing relation to said open portion and said hollow area and a second position permitting access to said hollow area through said open portion; and means on said upper wall for holding a jewelry item on said upper exposed surface, said means including at least one projection on an upper surface of said upper wall, said at least one projection including two L-shaped projections which face each other.

14. A jewelry pad for holding jewelry items, comprising:

an upper wall having an upper exposed surface;

at least one supporting wall connected to the upper wall for supporting the upper wall on a surface, said at least one supporting wall including substantially parallel side walls connected to side edges of said upper wall, and a rear wall connected to a rear edge of said upper wall;

a hollow area at an underside of said upper wall and between said at least one supporting wall, said hollow area having an open portion at a lower side of said at least one supporting wall;

a substantially vertical slit provided between each side wall and said rear wall for receiving a necklace chain therethrough; and a reinforcing wall connected between each said side wall and said rear wall to reinforce a connection between said side walls and said rear wall.

15. A jewelry pad according to claim 14, wherein each said slit substantially bisects a corresponding said reinforcing wall.

16. A jewelry pad according to claim 14, wherein each said reinforcing wall has a substantially inverted U-shape.

* * * * *